US009490081B2

(12) United States Patent
Tsukimori et al.

(10) Patent No.: US 9,490,081 B2
(45) Date of Patent: Nov. 8, 2016

(54) LIMIT SWITCH

(75) Inventors: Kazuyuki Tsukimori, Okayama (JP); Manabu Takahashi, Okayama (JP); Hiroyuki Moriyama, Tottori (JP); Shigenobu Fukui, Tottori (JP)

(73) Assignee: OMRON Corporation, Kyoto (JP)

( * ) Notice: Subject to any disclaimer, the term of this patent is extended or adjusted under 35 U.S.C. 154(b) by 43 days.

(21) Appl. No.: 14/368,814

(22) PCT Filed: Mar. 14, 2012

(86) PCT No.: PCT/JP2012/056494

§ 371 (c)(1),
(2), (4) Date: Jun. 26, 2014

(87) PCT Pub. No.: WO2013/105276

PCT Pub. Date: Jul. 18, 2013

(65) Prior Publication Data

US 2014/0326586 A1 Nov. 6, 2014

(30) Foreign Application Priority Data

Jan. 13, 2012 (JP) ..... 2012-005437

(51) Int. Cl.
*H01H 3/16* (2006.01)
*H01H 1/58* (2006.01)
(Continued)

(52) U.S. Cl.
CPC ..... *H01H 1/5855* (2013.01); *H01H 3/16* (2013.01); *H01H 9/02* (2013.01); *H01H 21/28* (2013.01); *H01H 21/285* (2013.01); *H01H 1/58* (2013.01);
(Continued)

(58) Field of Classification Search
CPC .... H01H 11/0006; H01H 1/58; H01H 21/28; H01H 21/285; H01H 3/16
USPC ..... 200/47
See application file for complete search history.

(56) References Cited

U.S. PATENT DOCUMENTS

2002/0104744 A1* 8/2002 Vignaud ..... H01H 21/28 200/47
2014/0326586 A1* 11/2014 Tsukimori ..... H01H 9/02 200/47

(Continued)

FOREIGN PATENT DOCUMENTS

| | | | |
|---|---|---|---|
| JP | 53-46572 | U | 4/1978 |
| JP | 63-19717 | U | 2/1988 |
| JP | 2001-043774 | A | 2/2001 |
| JP | 2009-211898 | A | 9/2009 |

OTHER PUBLICATIONS

International Search Report for corresponding International Application No. PCT/JP2012/056494, mailed May 22, 2012 (4 pages).

*Primary Examiner* — Renee Luebke
*Assistant Examiner* — Ahmed Saeed
(74) *Attorney, Agent, or Firm* — Osha Liang LLP

(57) ABSTRACT

A limit switch has a housing having an opening in a front surface of the housing, and a connection hole in which a lead wire is drawn made in a bottom surface of the housing, a switch main body fixed in the housing, a front surface of which is vertically partitioned into a plurality of stages, a pair of fixed contact terminals embedded at each of the stages, an operation shaft exposed from a ceiling surface of the switch main body, a contact that is opened and closed by driving the operation shaft in a shaft center direction, and a projection provided between the fixed contact terminals embedded at the stages of the front surface of the switch main body.

8 Claims, 9 Drawing Sheets

(51) Int. Cl.
*H01H 9/02* (2006.01)
*H01H 21/28* (2006.01)
*H01H 9/04* (2006.01)

(52) U.S. Cl.
CPC ..... *H01H 9/04* (2013.01); *H01H 2001/5883* (2013.01); *H01H 2207/036* (2013.01); *H01H 2231/038* (2013.01)

(56) References Cited

U.S. PATENT DOCUMENTS

2014/0360849 A1* 12/2014 Takahashi ..... H01H 3/42 200/47
2014/0374224 A1* 12/2014 Takahashi ..... H01H 21/285 200/47

* cited by examiner

LIMIT SWITCH

BACKGROUND

1. Technical Field

The present invention relates to a limit switch, particularly to a wiring structure of a lead wire connected to a fixed contact terminal of the limit switch.

2. Related Art

Conventionally, in the case that the lead wire is connected to the fixed contact terminal of the limit switch, as illustrated in FIG. 3 of Patent Document 1, four lead wires have been drawn through a connection hole (not illustrated) made in a bottom surface of base 1, and a crimped terminal provided at a leading end of the lead wire has been fixed to each of a pair of fixed contact terminals vertically provided at two stages using connection screw.

Patent Document 1: Japanese Unexamined Patent Publication No. 2001-43774

SUMMARY

In the conventional limit switch, although work to connect the lead wires to the pair of fixed contact terminals at the lower stage is relatively easy to perform, it takes a lot of work to perform routing of the lead wire when the lead wire is connected to the pair of fixed contact terminals at the upper stage. Particularly, for the connection of the thick lead wire in a narrow space, it is necessary to fold the lead wire in a complicated way in order to connect the lead wire to the fixed contact terminal at a position different from the drawn position, which results in work efficiency being degraded.

One or more embodiments of the present invention provides a limit switch in which the connection of the lead wire is easily perform with good work efficiency.

In accordance with one or more embodiments of the present invention, a limit switch, in which a switch main body is fixed into a housing including an opening in a front surface of the housing, a connection hole in which a lead wire is drawn is made in a bottom surface of the housing, a front surface of the switch main body is vertically partitioned into a plurality of stages, a pair of fixed contact terminals is embedded at each stage, and a contact is opened and closed by driving an operation shaft exposed from a ceiling surface of the switch main body in a shaft center direction. In the limit switch, a projection is provided between the fixed contact terminals embedded at the stages of the front surface of the switch main body.

According to one or more embodiments of the present invention, because the wiring can be performed by routing the lead wire through the projection, the connection work is facilitated to improve the work efficiency. Additionally, the limit switch having an excellent insulating characteristic is obtained because the fixed contact terminals adjacent to each other are partitioned by the projection.

In accordance with one or more embodiments of the present invention, in the limit switch, an outer circumferential surface of the projection may include a shape along a wiring route of the lead wire.

According to one or more embodiments of the present invention, the work to connect the lead wire can more efficiently be performed.

In accordance with one or more embodiments of the present invention, in the limit switch, the fixed contact terminal located at an upper stage may be arranged so as to be pushed out toward a near side from the fixed contact terminal located at a lower stage.

According to one or more embodiments of the present invention, a step is generated between the upper and lower fixed contact terminals. Therefore, even if the lead wire is connected to the fixed contact terminal on the lower stage side, the lead wire connected to the fixed contact terminal on the lower stage side does not obstruct the connection work of the fixed contact terminal on the upper stage side, and the efficiency of the connection work is further improved.

In accordance with one or more embodiments of the present invention, in the limit switch, an insulating wall may be provided, the insulating wall projecting toward the near side from an edge on at least one of both side surfaces of the switch main body.

According to one or more embodiments of the present invention, the insulating characteristic is further improved because the insulating wall can prevent the lead wire from abutting directly on an inside surface of the housing.

In accordance with one or more embodiments of the present invention, in the limit switch, the lead wire in which a crimped terminal is provided at a leading end thereof may be connected to the fixed contact terminal by a connection screw.

According to one or more embodiments of the present invention, because the lead wire can be connected to the fixed contact terminal through the crimped terminal, advantageously the connection work can further be facilitated to improve the work efficiency.

DETAILED DESCRIPTION

Hereinafter, embodiments of the present invention will be described with reference to FIGS. 1 to 9. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
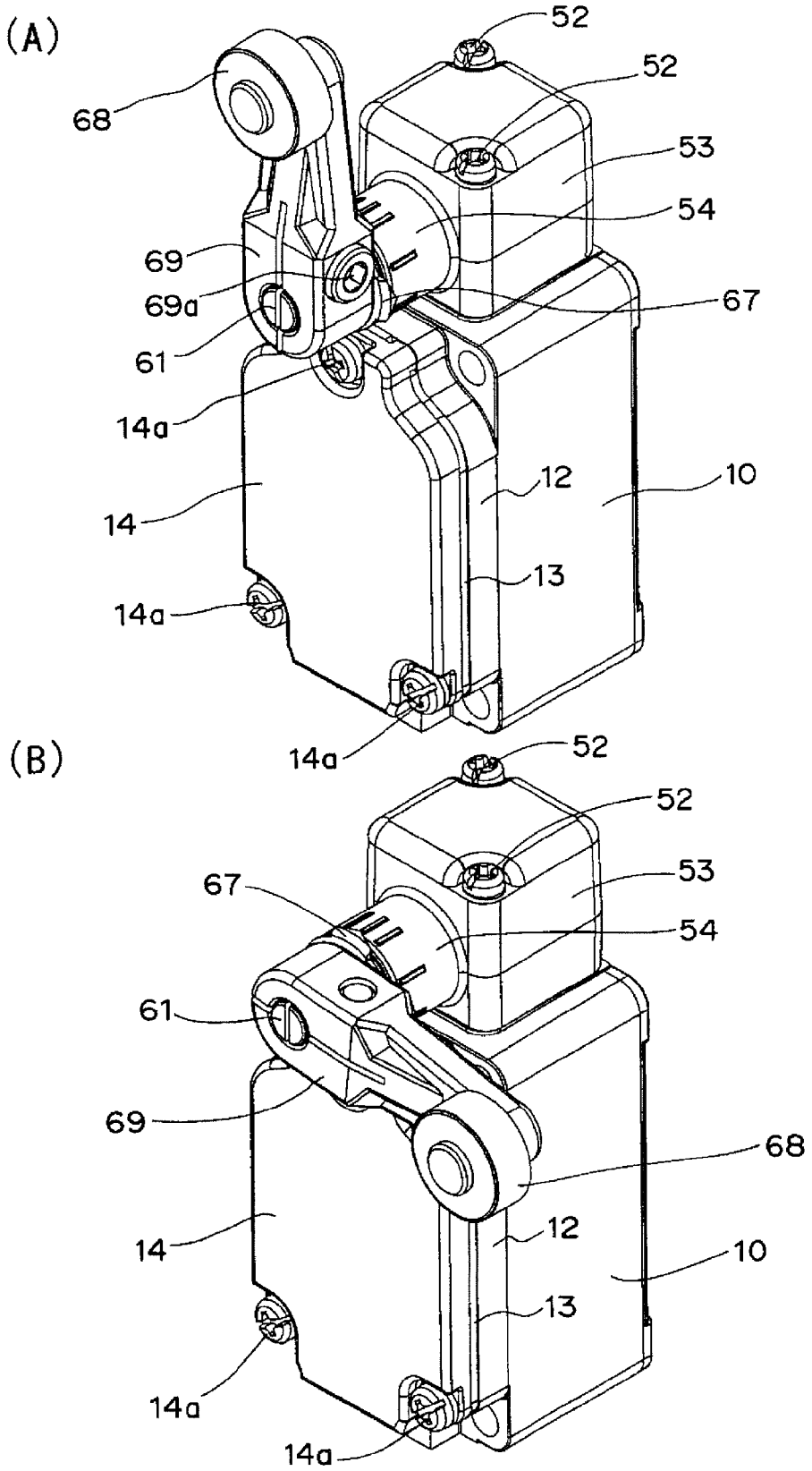
FIGS. 1A and 1B are perspective views illustrating before-and-after action of a limit switch according to a first embodiment of the present invention.
Figure 2:
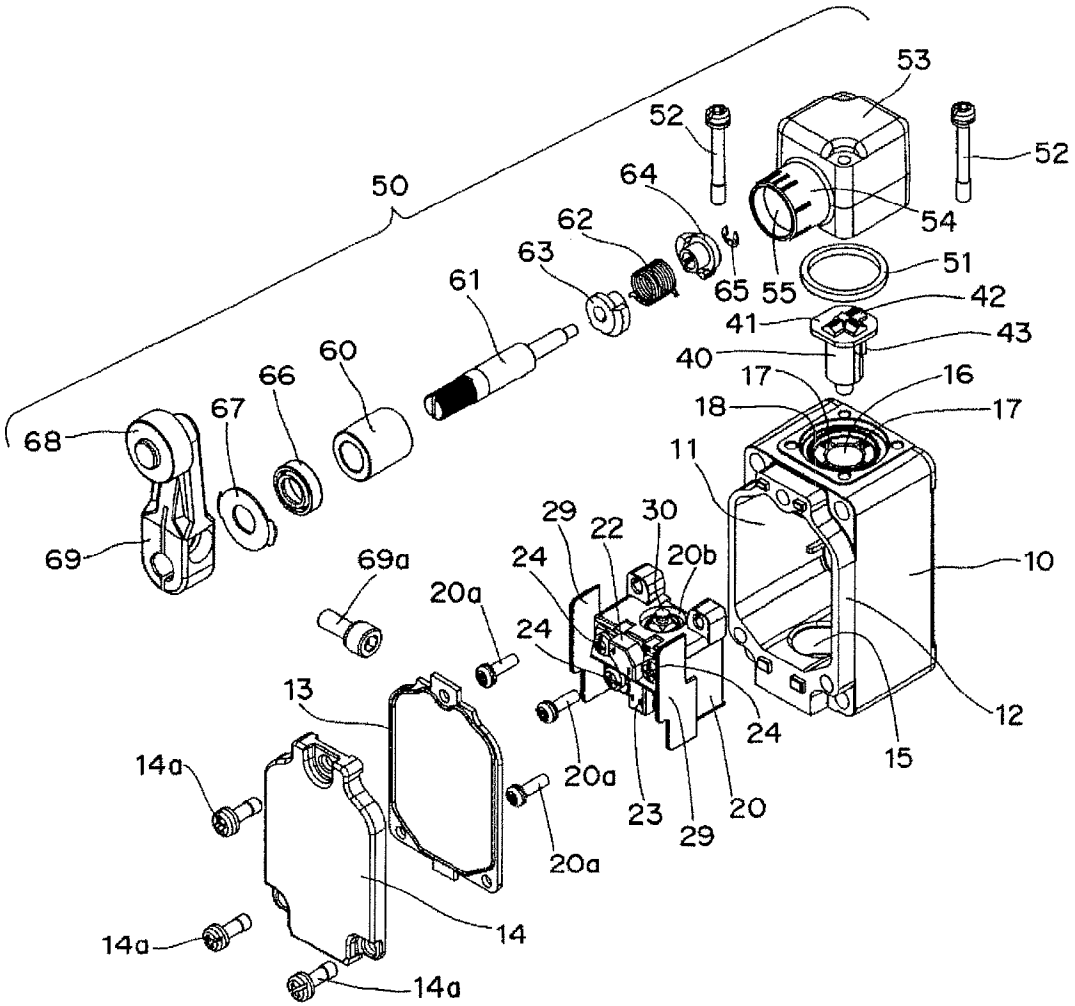
FIG. 2 is an exploded perspective view of the limit switch in FIG. 1.
Figure 3:
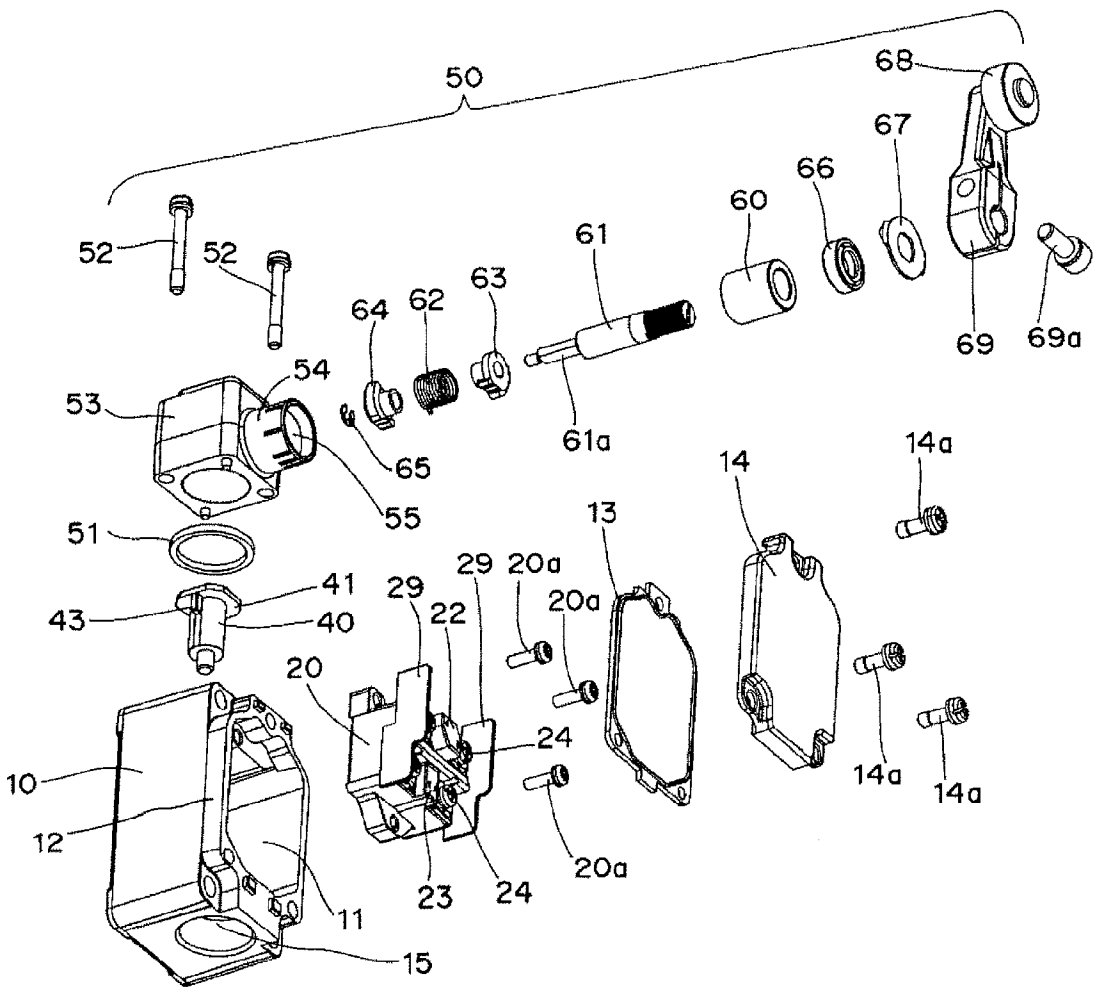
FIG. 3 is an exploded perspective view of the limit switch in FIG. 1 when viewed from a different angle.

As illustrated in FIGS. 1 to 3, in a limit switch according to a first embodiment, switch main body 20 assembled in housing 10 is driven by driving mechanism 50 including operation lever 69 through plunger 40.

Housing 10 has a box shape in which switch main body 20 can be accommodated, and circular rib 12 is formed along opening 11 provided in a front surface of housing 10. Circular seal member 13 is positioned in circular rib 12, and cover 14 is fixed to housing 10 by fixing screws 14*a*, thereby sealing opening 11. Connection hole 15 is made in a bottom surface of housing 10, and operation hole 16 is made in a ceiling surface of housing 10. Positioning slits 17 are radially formed in an inner circumferential surface of operation hole 16 at intervals of 90 degrees, and circular step 18 is concentrically formed near an opening edge of operation hole 16.

Switch main body 20 has an outer shape of which switch main body 20 can be accommodated from opening 11 of housing 10, and switch main body 20 is fixed to an inside surface of housing 10 by three fixing screws 20*a*.

Figure 4:
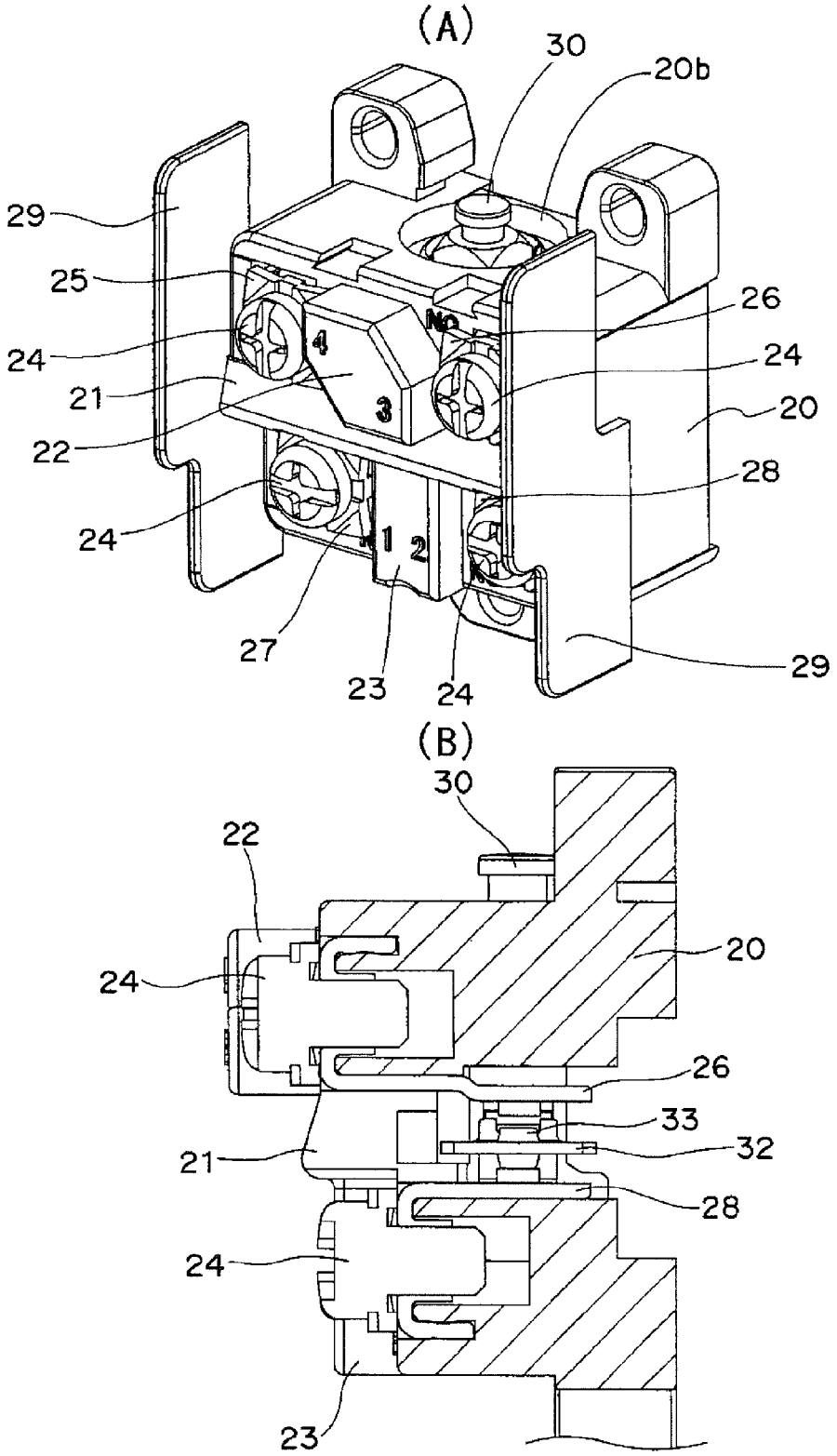
FIGS. 4A and 4B are an enlarged perspective view and a longitudinal sectional view of a switch main body in FIG. 2.
Figure 5:
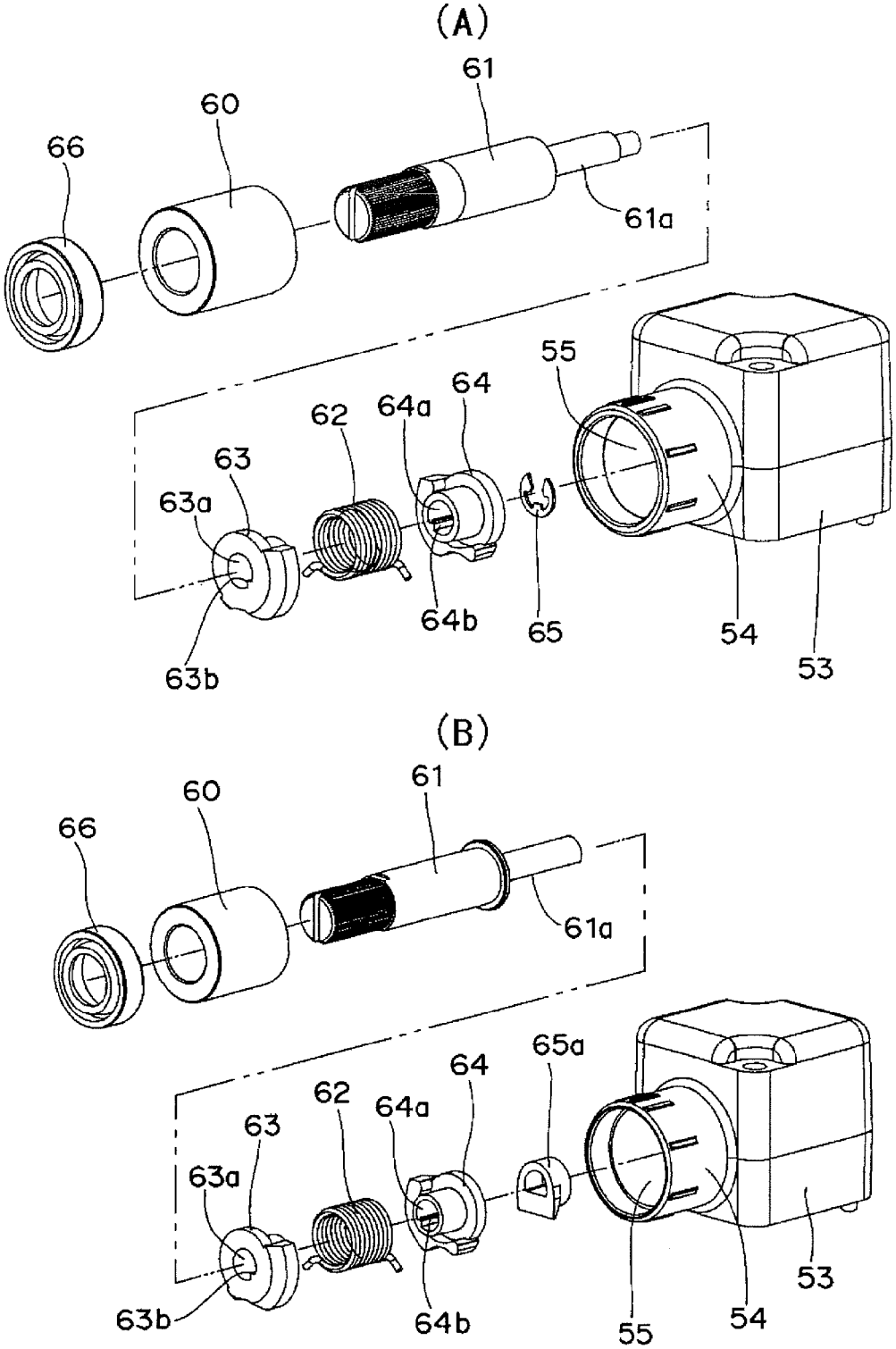
FIG. 5A is a partially exploded perspective view of a driving mechanism in FIG. 2.
FIG. 5B is a partially exploded perspective view illustrating a driving mechanism according to a second embodiment of the present invention.

As illustrated in FIG. 4, the front surface of switch main body 20 is vertically partitioned into two stages by partition rib 21, hexagonal first projection 22 is obliquely projected in a center of the upper stage, and square second projection 23 is projected in the center of the lower stage. Fixed contact terminals 25 and 26, each of which includes connection screw 24 and has a substantial U-shape in section, are embedded on both sides of first projection 22, and fixed contact terminals 27 and 28 each of which includes connection screw 24 are embedded on both sides of second projection 23.

Switch main body 20 is provided such that insulating walls 29 and 29 are pushed out onto a front side from end portions on both the sides of switch main body 20.

Figure 8:
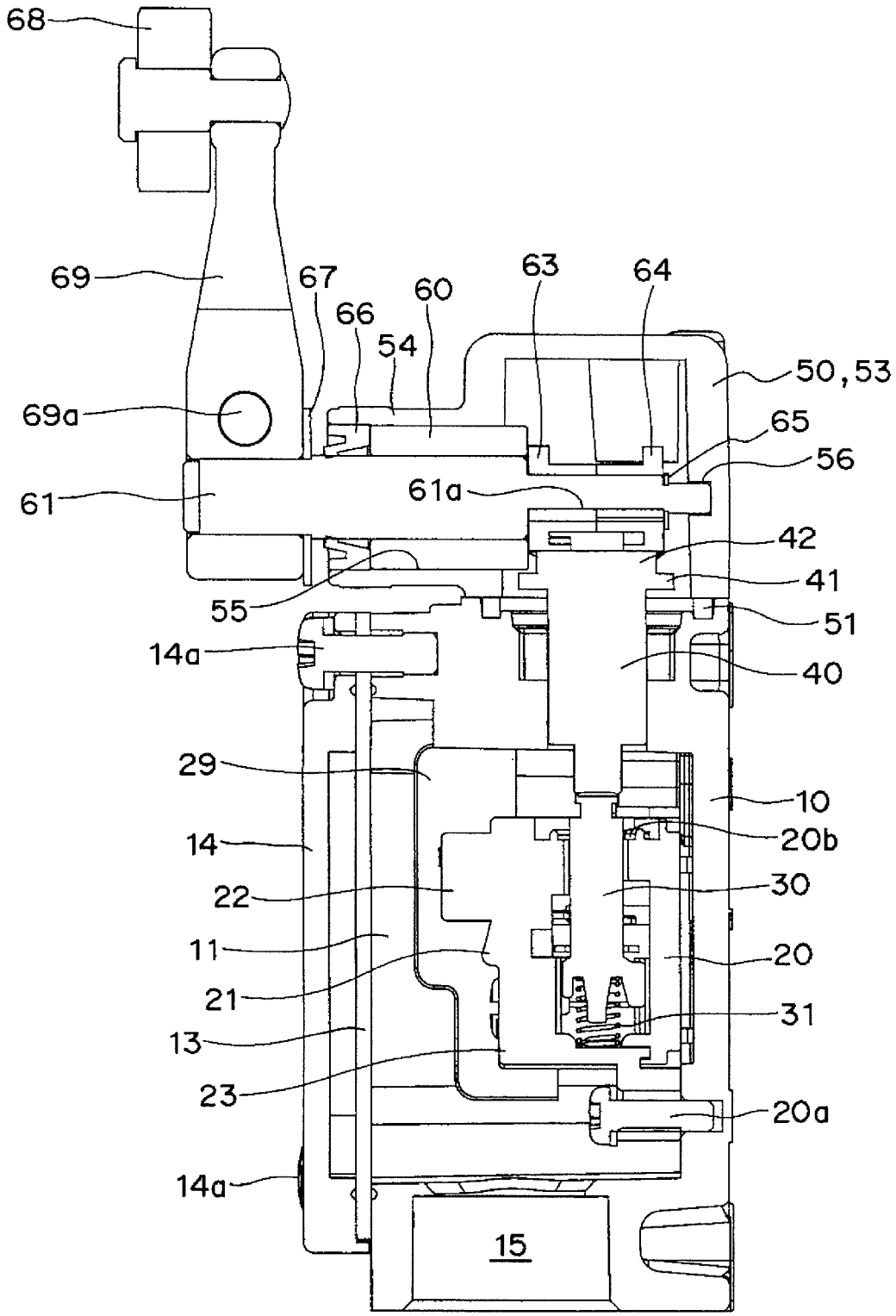
FIG. 8 is a longitudinal sectional view illustrating a center of the limit switch in FIG. 1 before the action.
Figure 9:
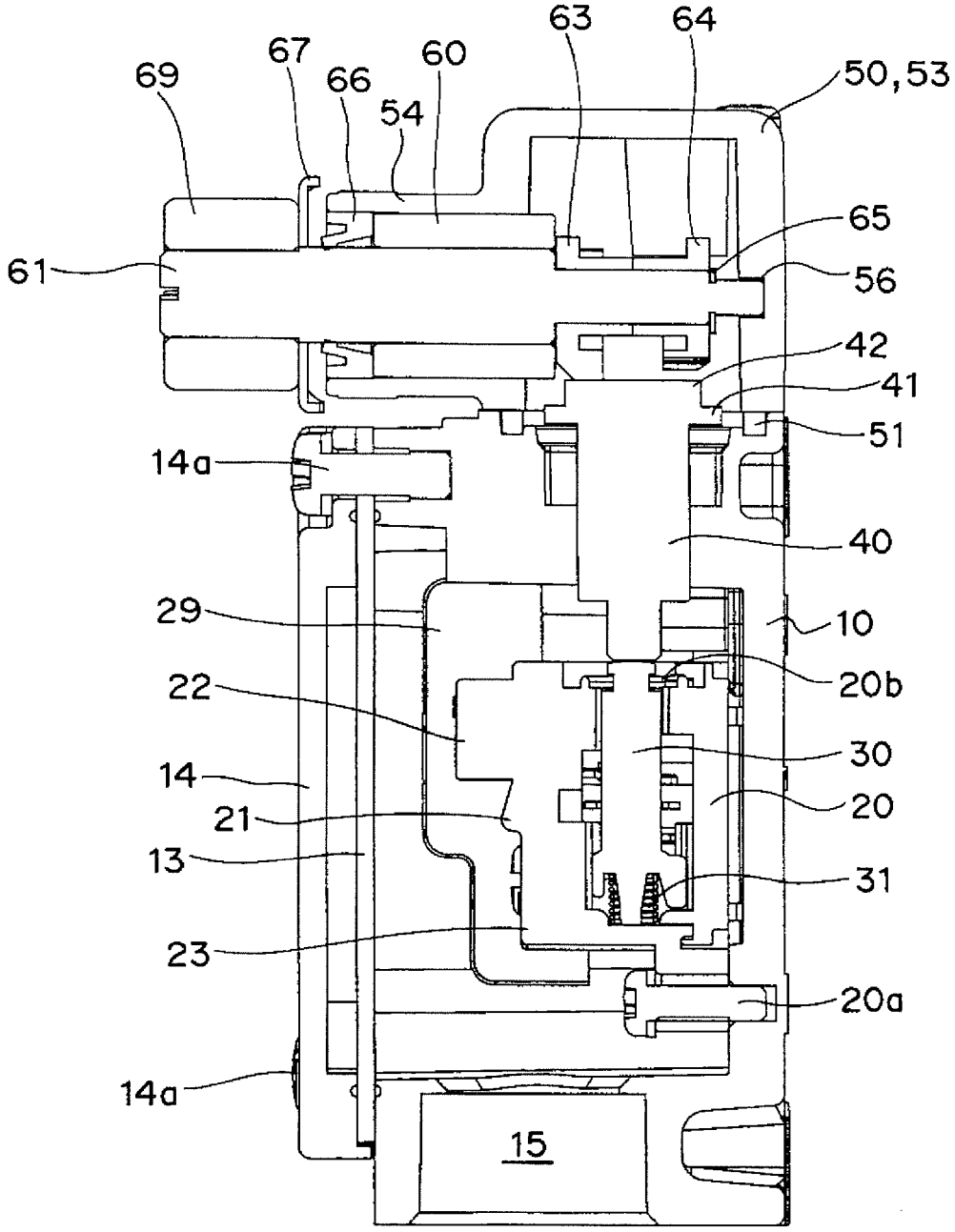
FIG. 9 is a longitudinal sectional view illustrating the center of the limit switch in FIG. 1 after the action.

As illustrated in FIGS. 8 and 9, operation shaft 30 is supported in switch main body 20 while being vertically slidable, and operation shaft 30 is biased upward by coil spring 31. Therefore, an upper end of operation shaft 30 projects from operation hole 20*b* made in the ceiling surface of switch main body 20. In operation shaft 30, movable touch piece 32 in FIG. 4 is vertically inverted, whereby movable contacts 33 provided at both ends of movable touch piece 32 alternately comes into contact with and separates from fixed contacts of fixed contact terminals 25 and 26 and fixed contacts of fixed contact terminals 27 and 28.

As illustrated in FIGS. 2 and 3, plunger 40 has the outer shape that can vertically move along operation hole 16 of housing 10, operating ridge 42 having a substantial T-shape is provided in an upper surface of guard portion 41 of plunger 40, and guide rib 43 is provided in a base of a lower surface of guard portion 41. Guide rib 43 of plunger 40 is selectively fitted in one of positioning slits 17 provided in housing 10, whereby a lower end of plunger 40 abuts on an upper end of operation shaft 30 to be able to detect a rotation direction of operation lever 69 which is described below.

As illustrated in FIG. 2, driving mechanism 50 is assembled in box 53 that is fixed to the upper surface of housing 10 with seal ring 51 interposed therebetween by fixing screws 52.

That is, as illustrated in FIG. 8, rotating shaft 61 is rotatably inserted in cylindrical bearing section 60 that is press-fixed through attachment hole 55 of cylindrical rib 54 provided in box 53. The leading end portion of rotating shaft 61 is fitted in bearing recess 56 provided in the inside surface of box 53, and a pair of circular cams 63 and 64 sandwiching return coil spring 62 is retained on a leading end side of rotating shaft 61 by E-ring 65 (for the sake of convenience, return coil spring 62 is not illustrated in FIGS. 8 and 9).

Particularly, as illustrated in FIG. 5A, circular cams 63 and 64 respectively include through-holes 63*a* and 64*a* that can be fitted in the leading end portion of rotating shaft 61 in which flat surface 61*a* (FIG. 3) is provided. Ridges 63*b* and 64*b* having a triangular shape in section are projected along a shaft center direction in the inner circumferential surfaces of through-holes 63*a* and 64*a*, respectively, and ridges 63*b* and 64*b* can be latched in an edge of flat surface 61*a* of rotating shaft 61. Both the ends of return coil spring 62 are latched in circular cams 63 and 64 to provide a biasing force in the rotation direction to rotating shaft 61. This is because operation lever 69, which is described later, is returned to an original position.

On the other hand, as illustrated in FIG. 2, rubber oil seal 66 is mounted on the rear end side of rotating shaft 61 projecting from cylindrical rib 54, and setting position display panel 67 is engaged with the rear end side of rotating shaft 61. Operation lever 69 including roller 68 is fixed to the rear end of rotating shaft 61 by adjustment screw 69*a*.

Not only circular cams 63 and 64 are fixed by E-ring 65, but also circular cams 63 and 64 may be retained by stopper 65*a* press-fixed into the leading end portion of rotating shaft 61 like a second embodiment in FIG. 5B. Because other configurations of the second embodiment are similar to those of the first embodiment, the same component is designated by the same numeral, and the description is omitted.

A method for assembling the limit switch having the above constituent will be described below.

Switch main body 20 is inserted from opening 11 of housing 10, and fixed by three fixing screws 20*a*. On the other hand, guide rib 43 of plunger 40 is selectively fitted in positioning slit 17 provided in operation hole 16 of housing 10. Seal ring 51 is fitted in circular step 18 provided around operation hole 16, and box 53 is fixed to housing 10 by fixing screws 52.

On the other hand, circular cam 63, return coil spring 62, and circular cam 64 are sequentially inserted on the leading end side of rotating shaft 61, and retained by E-ring 65. Cylindrical bearing section 60 is press-fixed into attachment hole 55 after rotating shaft 61 is inserted from attachment hole 55 of box 53 to fit the leading end portion of rotating shaft 61 in bearing recess 56 (FIG. 8) provided in the inside surface of box 53. Therefore, cylindrical bearing section 60 abuts on the outward surface of circular cam 63 to retain rotating shaft 61. At this point, circular cams 63 and 64 abut on operating ridge 42 of plunger 40. Rubber oil seal 66 is fitted on the rear end side of rotating shaft 61 projecting from box 53, whereby setting position display panel 67 is engaged while the sealing is performed. Then the operation lever 69 is attached to the rear end of rotating shaft 61, and fixed by adjustment screw 69*a*.

After circular seal member 13 is positioned in circular rib 12, cover 14 is fixed to housing 10 by fixing screws 14*a* to complete the assembly work.

In the case that lead wires are connected to switch main body 20 on site, after cover 14 is detached, connection terminals of lead wires 70 and 71 are fixed to fixed contact terminals 27 and 28 on the lower stage side, respectively, by connection screws 24 as illustrated in FIG. 6A. Then, as illustrated in FIG. 6B, the connection terminal of lead wire 72 is fixed to fixed contact terminal 26 by connection screw 24. Finally, lead wire 73 is fixed to fixed contact terminal 25 by connection screw 24 to complete the connection work.

According to the first embodiment, a creeping distance is lengthened by partition rib 21, and first and second projections 22 and 23 act as the insulating wall. Therefore, the limit switch having an excellent insulating characteristic is obtained.

Figure 6:
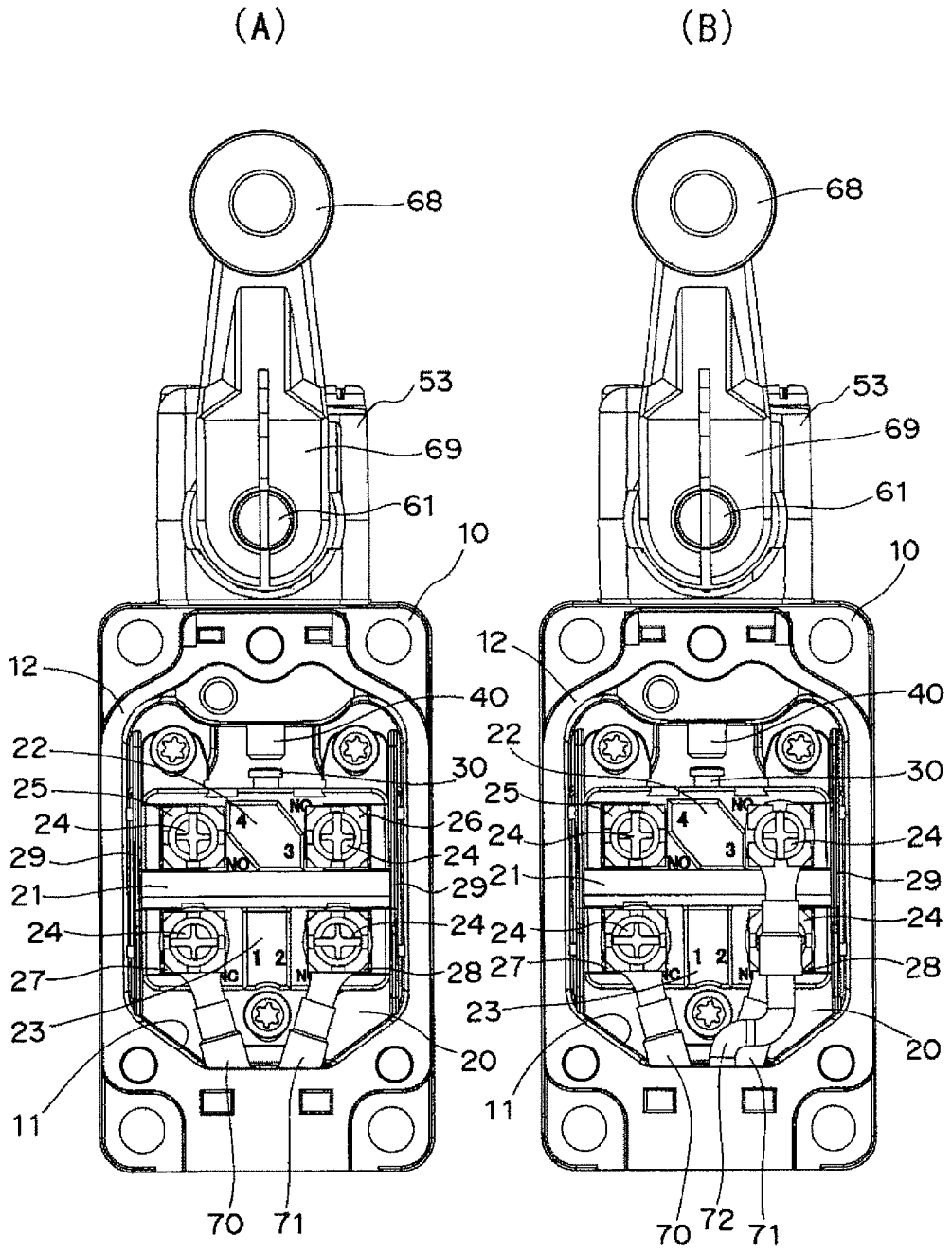
FIGS. 6A and 6B are front views illustrating a method for connecting a lead wire to the limit switch in FIG. 1.
Figure 7:
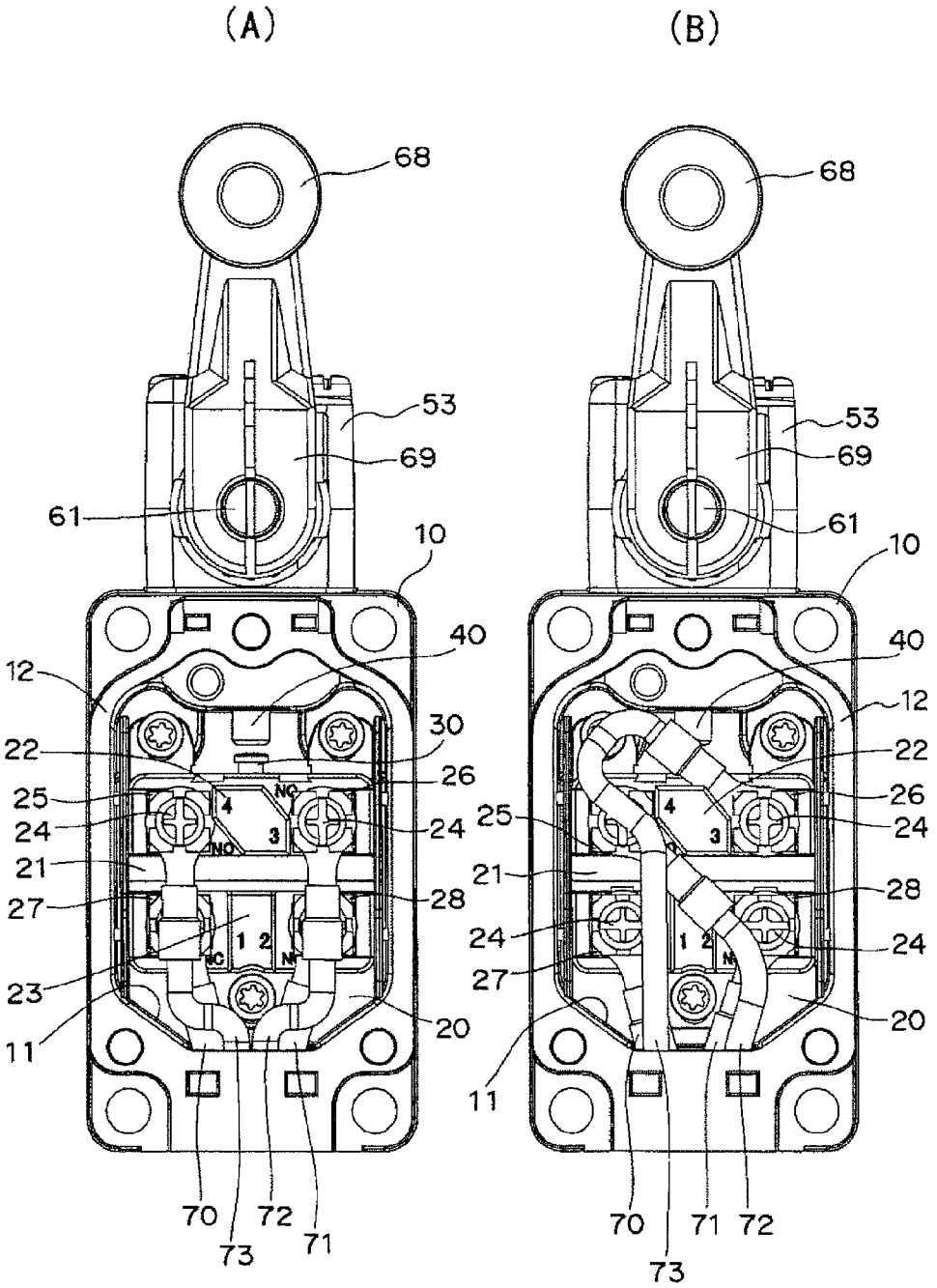
FIG. 7A is a front view continuous with FIG. 6B.
FIG. 7B is a front view illustrating another connection method.

In the case that the connection is performed by a connection structure different from that in FIG. 6, as illustrated in FIG. 7B, lead wire 72 is folded along first projection 22 and connected to fixed contact terminal 25, and lead wire 73 may be detoured along first projection 22 and connected to fixed contact terminal 26.

According to the first embodiment, an outer circumferential surface of first projection 22 has a shape (a shape, such as a substantial hexagon and a substantial parallelogram, which includes a region where at least two pairs of line segments substantially parallel to each other are coupled to each other at an angle different from a right angle when first projection 22 is viewed from the front surface) along wiring routes of lead wires 72 and 73, so that advantageously the connection work can efficiently be performed.

Action of the limit switch of the first embodiment will be described below.

In the case that an external force is not applied to operation lever 69 as illustrated in FIGS. 8 and 9, operation lever 69 is vertically provided and only the pair of cams 63 and 64 abuts on operating ridge 42 of plunger 40, but cams 63 and 64 do not push down plunger 40. Therefore, operation shaft 30 is pushed up by a spring force of coil spring 31, and movable contact 33 of movable touch piece 32 is in contact with fixed contact terminals 25 and 26.

When operation lever 69 rotates clockwise by the external force, the edge on one side of flat surface 61*a* provided in rotating shaft 61 is latched in ridge 63*b* of circular cam 63. Only circular cam 63 rotates to push down operating ridge 42 of plunger 40, thereby pushing down operation shaft 30. As a result, movable touch piece 32 is pushed down and inverted, and movable contact 33 is switched from fixed contact terminals 25 and 26 to fixed contact terminals 27 and 28.

When the external load is released, rotating shaft 61 rotates in the opposite direction by the spring force of return coil spring 62, operation lever 69 returns to the original position, and operation shaft 30 and plunger 40 are pushed up by the spring force of coil spring 31.

On the other hand, when operation lever 69 rotates counterclockwise by the external force, the edge on the other side of flat surface 61*a* provided in rotating shaft 61 is latched in ridge 64*a* of circular cam 64. Only circular cam 64 rotates to push down operating ridge 42 of plunger 40, thereby pushing down operation shaft 30. As a result, movable touch piece 32 is pushed down and inverted, and movable contact 33 is switched from fixed contact terminals 25 and 26 to fixed contact terminals 27 and 28.

When the external load is released, rotating shaft 61 rotates in the opposite direction by the spring force of return coil spring 62, operation lever 69 returns to the original position, and operation shaft 30 and plunger 40 are pushed up by the spring force of coil spring 31.

In the first embodiment, guide rib 43 is engaged with selected positioning slit 17 when plunger 40 is assembled in housing 10, for example, the clockwise external force can be detected while the counterclockwise external force is not detected.

The operation lever is not necessarily attached in the vertical direction. For example, the operation lever may be attached in a horizontal or oblique direction.

In one or more of the above embodiments, the four lead wires are connected to the limit switch by way of example. Alternatively, for example, six or eight lead wires may be connected to the limit switch.

One circular cam may be attached to the rotating shaft.

One or more embodiments of the present invention can be applied to not only the limit switch but also limit switches having other shapes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10: housing
11: opening
14: cover
15: connection hole
16: operation hole
20: switch main body
21: partition rib
22: first projection
23: second projection
24: connection screw
25, 26, 27, 28: fixed contact terminal
29: insulating wall
30: operation shaft
31: coil spring
40: plunger
41: guard portion
42: operating ridge
43: guide rib
50: driving mechanism
51: seal ring
52: fixing screw
53: box
54: cylindrical rib
55: attachment hole
56: bearing recess
60: cylindrical bearing section
61: rotating shaft
61*a*: flat surface
62: return coil spring
63, 64: circular cam
65: E-ring
65*a*: stopper
66: oil seal
67: setting position display panel
68: roller
69: operation lever
70, 71, 72, 73: lead wire

The invention claimed is:

1. A limit switch comprising:

a housing comprising:

an opening in a front surface of the housing, and a connection hole in which a lead wire is drawn made in a bottom surface of the housing;

a switch main body fixed in the housing, a front surface of which is vertically partitioned into a plurality of stages;

a pair of fixed contact terminals embedded at each of the stages;

an operation shaft exposed from a ceiling surface of the switch main body;

a contact that is opened and closed by driving the operation shaft in a shaft center direction; and a projection provided between the fixed contact terminals embedded at the stages of the front surface of the switch main body, wherein an outer circumferential surface of the projection comprises a shape along a wiring route of the lead wire, and wherein the projection has a hexagonal shape.

2. The limit switch according to claim 1, wherein the fixed contact terminal located at an upper stage is arranged so as to be pushed out toward a near side from the fixed contact terminal located at a lower stage.

3. The limit switch according to claim 2, wherein an insulating wall is provided, the insulating wall projecting toward the near side from an edge on at least one of both side surfaces of the switch main body.

4. The limit switch according to claim 2, wherein the lead wire in which a crimped terminal is provided at a leading end thereof is connected to the fixed contact terminal by a connection screw.

5. The limit switch according to claim 1, wherein an insulating wall is provided, the insulating wall projecting toward the near side from an edge on at least one of both side surfaces of the switch main body.

6. The limit switch according to claim 5, wherein the lead wire in which a crimped terminal is provided at a leading end thereof is connected to the fixed contact terminal by a connection screw.

7. The limit switch according to claim 1, wherein the lead wire in which a crimped terminal is provided at a leading end thereof is connected to the fixed contact terminal by a connection screw.

8. The limit switch according to claim 1, wherein the projection comprises first and second walls at right angles to each other, third and fourth walls at right angles to each other, and fifth and sixth walls that are parallel to each other and connect the first and second walls to the third and fourth walls.

* * * * *